United States Patent [19]

Bütikofer et al.

[11] Patent Number: 4,881,872

[45] Date of Patent: Nov. 21, 1989

[54] STEAM TURBINE FOR PART LOAD OPERATION

[75] Inventors: Jürg Bütikofer, Niedererlinsbach; Hans Meyer, Fislisbach, both of Switzerland

[73] Assignee: BBC Brown Boveri AG, Baden, Switzerland

[21] Appl. No.: 208,502

[22] Filed: Jun. 20, 1988

[30] Foreign Application Priority Data

Jun. 26, 1987 [CH] Switzerland ..... 2426/87

[51] Int. Cl.[4] ..... F01D 9/04

[52] U.S. Cl. ..... 415/143; 415/199.5; 415/209.1

[58] Field of Search ..... 415/143, 199.5, 208, 415/217, 187, 185, 209.1

[56] References Cited

U.S. PATENT DOCUMENTS

| | | | |
|---|---|---|---|
| 797,064 | 8/1905 | Lindmark | 415/143 |
| 1,542,453 | 6/1925 | Hodgkinson | 415/210 |
| 2,187,778 | 1/1940 | Kraft | 415/199.5 X |
| 2,396,159 | 3/1946 | Cook et al. | 415/210 X |
| 4,218,180 | 8/1980 | Wikstrom | 415/199.5 X |
| 4,403,915 | 9/1983 | Teufelberger | 415/199.5 |

FOREIGN PATENT DOCUMENTS

| | | | |
|---|---|---|---|
| 520226 | 2/1931 | Fed. Rep. of Germany . | |
| 599042 | 8/1932 | Fed. Rep. of Germany | 415/199.5 |
| 694316 | 7/1940 | Fed. Rep. of Germany . | |
| 713016 | 10/1941 | Fed. Rep. of Germany . | |
| 2015056 | 10/1970 | Fed. Rep. of Germany | 415/210 |

*Primary Examiner*—Robert E. Garrett
*Assistant Examiner*—Joseph M. Pitko
*Attorney, Agent, or Firm*—Burns, Doane, Swecker & Mathis

[57] ABSTRACT

In steam turbines operated with nozzle group control (3) in part load operation, a swirl cascade (4) is fitted downstream of the control wheel (2) in the flow direction. The partial flows emerging from the control wheel (2) are provided with a distinct swirl in the swirl cascade (4) and released into the transfer duct (9). The full admission reaction blading (7, 8) of the turbine is located at the end of this transfer duct, the flow being directly admitted to a first rotor blade row (7).

5 Claims, 4 Drawing Sheets

STEAM TURBINE FOR PART LOAD OPERATION

BACKGROUND OF THE INVENTION

1. Field of the Invention

The invention concerns a steam turbine which is operated with nozzle group control in the part load range.

2. Discussion of Background

Control wheels with separately opening nozzle groups are used for partial admission in steam turbine construction because the efficiency obtainable by this means over the important power range is better than that of other systems, the effect of the control wheel being to extract work from the steam in such a way that the power control is, in itself, optimal. In order to achieve full admission in the following stages, an equalizing space is provided to permit the transition from partial admission to full admission.

In the case of steam turbines in the small power class, which use by a small quantity of steam and have a small rotor diameter, the diameter of the control wheel is made larger than the diameter of the subsequent stages. In consequence, sufficient space is gained between the outlet plane of the partial admission control wheel and the inlet plane of the first full admission stage for the flow to become more or less evenly distributed over the whole cross-section of the flow duct between the control wheel and the entry into the following part of the turbine so that the losses due to inhomogeneous flow in the full admission stages remain small.

In steam turbines of larger powers which use large steam quantities and have large rotor diameters, however, it is not possible to design the control wheel so that it is much larger than the subsequent full admission part. In consequence, the space available between the partial admission control wheel and the subsequent full admission part of the turbine, for equalizing the flow over the complete periphery of the flow duct is smaller and flow inhomogeneities remain. An excessively small wheel space then leads to substantial losses in part load operation also. In the extreme case, the control wheel could be designed to have the same diameter as the blading of the following turbine stage; in this case, however, a special equalizing section would be necessary - in the form of a very large axial distance or a flow reversal, for example - which implies a lengthening and/or deterioration of the turbine. Another disadvantage in the case of flow inhomogeneities is that the blades of the stages following the control wheel can then be excited to undergo damaging vibrations.

SUMMARY OF THE INVENTION

Accordingly, one object of this invention, is to provide equalization of the flow on transition from partial admission in the control stage to full admission in the remaining stages of steam turbines of the type mentioned at the beginning and operated at part load.

The object is primarily achieved by installing a swirl cascade behind the control wheel, the first nozzle guide vane row of the subsequent turbine blading at the same time being omitted.

The mode of operation is such that the swirl cascade provides the mass flow emerging from the control wheel with a distinct swirl before it is released into the transfer duct. The swirl generates an additional pressure gradient in the peripheral direction in the case of partial admission and this produces a tangential equalizing flow. Another substantial advantage of the invention may be seen in the fact that the solution can be applied equally well even if there is no diameter difference between the control wheel and subsequent blading: the space requirement is no larger than that in existing control wheel machines so that the solution is extremely suitable for retrofitting in existing installations.

One possible variant is to match the conventional, first nozzle guide vane row to the flow emerging from the swirl cascade in such a way that there is less deflection in this guide row.

BRIEF DESCRIPTION OF THE DRAWINGS

A more complete appreciation of the invention and many of the attendant advantages thereof will be radially obtained as the same becomes better understood by reference to the following detailed description when considered in connection with the accompanying drawings, wherein.

The invention applies equally to turbines of the reaction and impulse types so that the illustrative examples should be understood as being for one type or the other.

DESCRIPTION OF THE PREFERRED EMBODIMENTS

Figure 1:
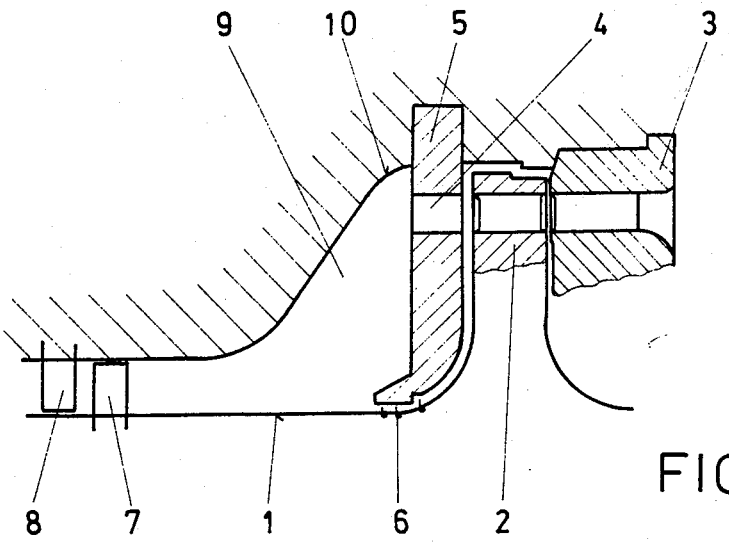
FIG. 1 is a view of a basic type with installed swirl cascade, the first reaction guide vane row having been already removed.

Referring now to the drawings, wherein like reference numerals designate identical or corresponding parts throughout the several views, an excerpt from a steam turbine can be seen in FIG. 1 which shows, in fact, the region between nozzle 3, control wheel 2 and the first blading rows 7, 8 of the turbine. In the control part shown, the diameter of the control wheel 2 is greater than the diameters of the hub 1 and the first rotor blade row 7. The diameter difference must then be maintained in such a way that the duct volume is sufficient for complete homogenization of the flow over the whole of the duct periphery for a length of the transition duct 9, between control stage and reaction stage, which is tolerable from the point of view of manufacturing costs. A plate 5, in which is installed a swirl cascade 4 permitting controlled swirl outlet flow, is provided after the control wheel 2 in the flow direction. The plate 5 is fixed in the stator 10 and extends, in its radial direction, as far as the external diameter of the hub 1. Seals 6, which minimize a leakage flow between the control wheel 2 and the plate 5, are provided at this point. From the point of view of the mode of operation, it may be stated that the swirl cascade 4 provides the partial flows emerging from the control wheel 2 with a distinct swirl and then releases them into the transfer duct 9. The equalization of the flow also occurs here. The dynamic excitation forces on the following blades, in particular on the first rotor blade row 7, are minimized by the flow equalization achieved in this manner. It is advantageous to omit the first nozzle guide vane row, as shown in FIG. 1, because the design of the swirl cascade 4 and the additional increase in swirl due to the flow guidance in the previously mentioned transfer duct 9 preferably occurs in such a way that a favorable inlet flow to the first rotor row is achieved. due to the installation of the present swirl cascade 4, the space requirement is no larger than that in existing control wheel machines so that the method is extremely suitable for retrofitting in existing installations.

Figure 2:
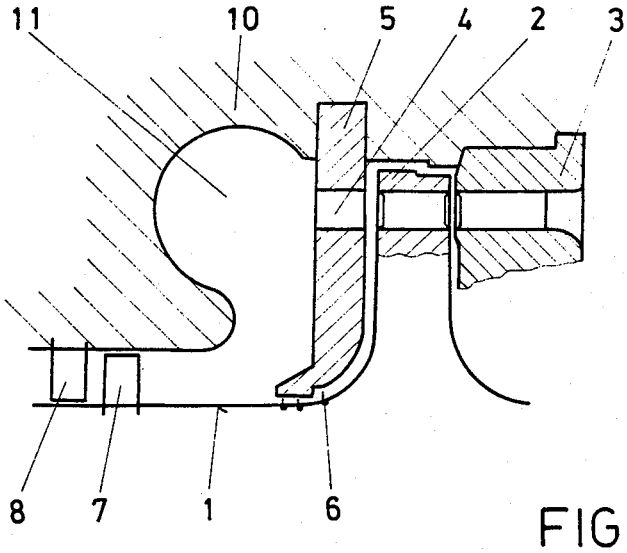
FIG. 2 is a view of a further type but with additional swirl space.

FIG. 2 differs from FIG. 1 only in the design of the transfer duct 9. Whereas in FIG. 1, the transfer duct 9 describes a direct line to the blading rows, the transfer duct of FIG. 2 has an additional swirl space 11, which widens to form a curved recess in the stator 10 immediately after the swirl cascade 4. This swirl space 11 is an additional equalization space in which the flow is deflected in the direction of the rotor blades 7.

Figure 3:
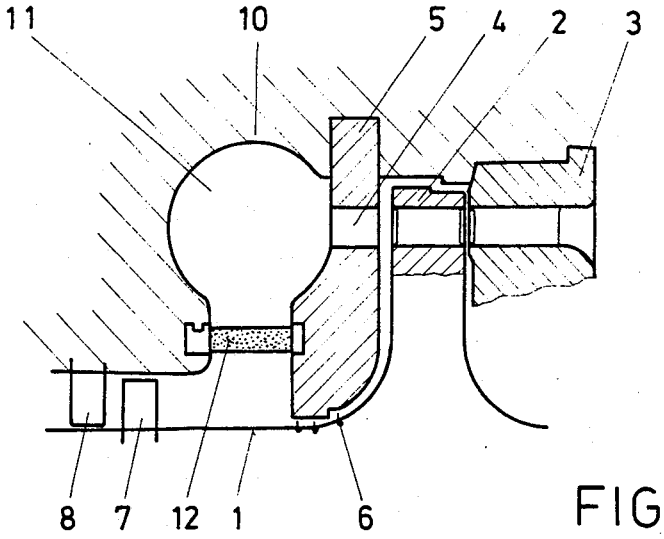
FIG. 3 is a view of a further type with additional swirl space and radial guide cascade for swirl correction.

Compared with FIG. 2, FIG. 3 has an additional means, again pursuing the purpose mentioned of providing the rotor blades 7 with an optimum flow. A radial guide cascade 12, which permits flow swirl correction in all cases, is provided immediately after the swirl space 11. This swirl cascade 12 is mounted between stator 10 and plate 5.

Figure 4:
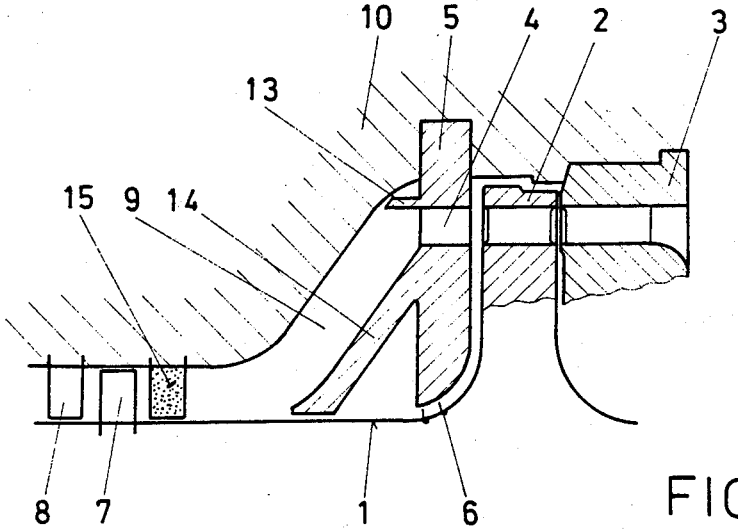
FIG. 4 is a view of a further type with additional means for flow guidance and a swirl correction cascade.

FIG. 4 shows a further variant for optimizing the swirl effect from outlet from the swirl cascade 4. In this first place, there are the flow guides 13 and 14 which also control the flow area in the transfer duct 9. A first guide 13 forces the flow from swirl cascade 4 to flow immediately through the transfer duct 9. A further guide 14 also extends from swirl cascade 4 in the flow direction parallel to the wall of the transfer duct 9. The end of the flow guide 14 is shaped at outlet to provide transfer aid for the change in the direction of the flow. A swirl correction cascade 15 can be provided immediately in front of the first rotor blade row 7.

Figure 5:
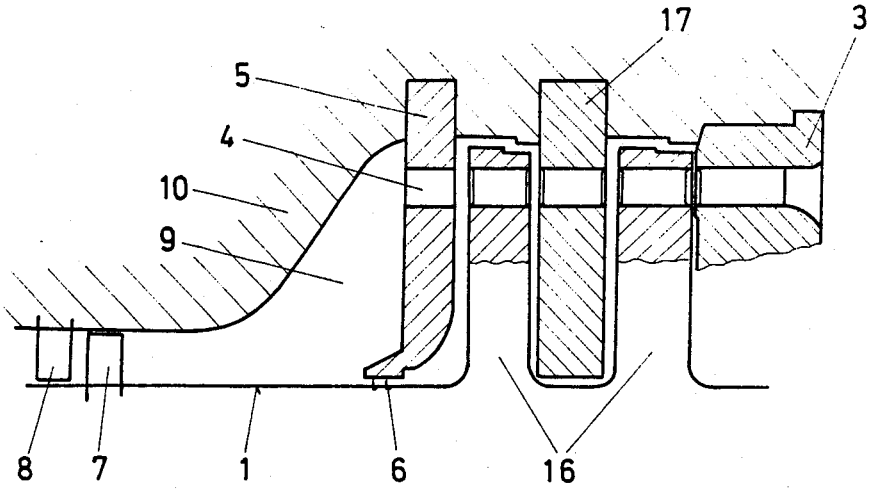
FIG. 5 is a view of a further type with several partial admission stages before the swirl cascade.

The arrangement shown in FIG. 5 corresponds to that in FIG. 1 with the difference that in this case, two or more partial admission stages 16 act before the swirl cascade 4. A partial admission guide cascade 17 is provided between each pair of partial admission rotor wheels 16. Such an arrangement is particularly suitable for the admission of very small inlet volume flows so that partial admission can be provided over several stages with subsequent equalization over the whole periphery.

Figure 6:
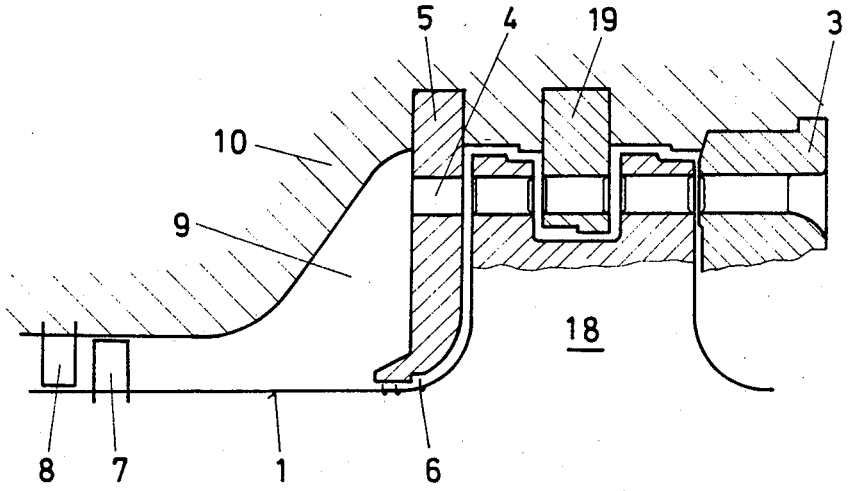
FIG. 6 is a view of a further type with a "Curtis stage" before the swirl cascade.

In this connection, the design shown in FIG. 6 must also be considered. The only difference from the previous figure is the arrangement selected upstream of the swirl cascade 4. In this case, a "Curtis stage" 18, 19 is involved. Reference should be made inter alia to A. Stodola, Dampf-und Gasturbinen, Fifth Edition, Berlin 1922, p. 496 ff. and W Traupel, Thermische Turbomaschinen, Vol. 1, Third Edition, Berlin 1977, p. 152 ff. with respect to the technical features of the "Curtis stage" 18, 19.

Figure 7:
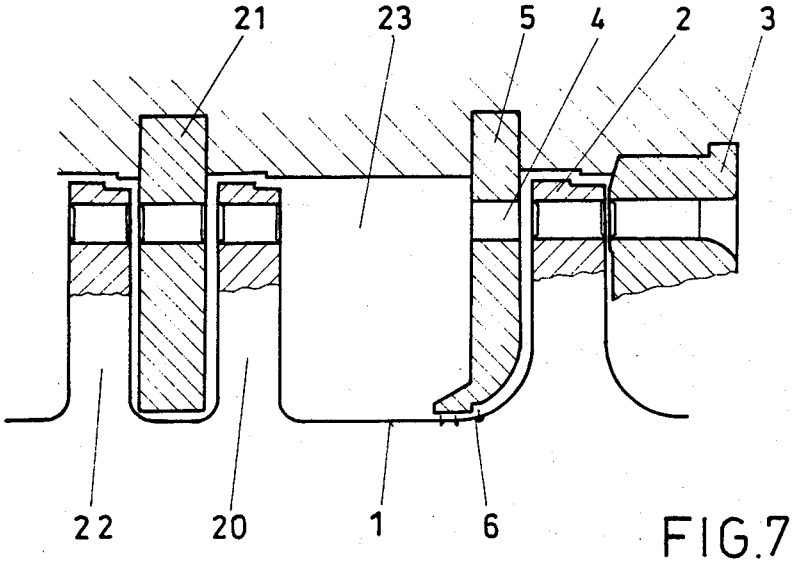
FIG. 7 is a view of further type without diameter differences between control wheel and impulse blading of the turbine and FIG. 8 is a view of a swirl cascade whose admission arc is matched to the admission arc of the previous control stage.

FIG. 7 shows a different type in which the impulse wheels 20, 21 and 22 used in the turbine do not have any diameter difference relative to the control stage 2, 3 located upstream. The intermediate space 23 is dimensioned in such a way that the swirl flow generated by the swirl cascade 4 is not impermissibly reduced before admission to the full admission impulse rows 20, 21 and 22.

Figure 8:
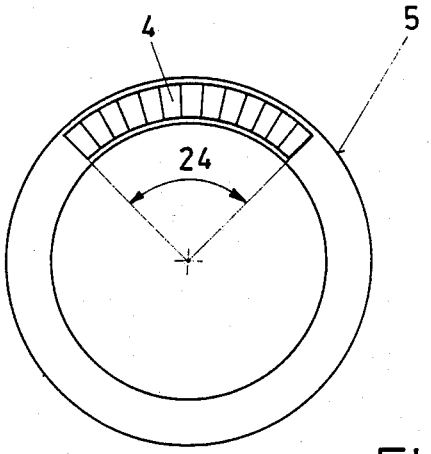

FIG. 8 shows the plate 5 and the swirl cascade 4 in an axial view. The impulse type swirl cascade 4 is reduced to an admission arc zone 24 so that it acts in conjunction with the nozzle cascade of the control stage. The rest of the periphery is smooth and acts as an additional windage protection. The angular dimension of the admission arc 24 follows from the admission arc of the nozzle cascade 4. This design is provided for small mass flows in which the full periphery of the plate 5 is not required.

Obviously numerous modifications and variations of the present invention are possible in light of the above teachings. It is therefore to be understood that within the scope of the appended claims, the invention may be practiced otherwise than as specifically described herein.

What is claimed as new and desired to be secured by letters patent of the United States is:

1. A steam turbine designed to maximize efficiency in a part load range, comprising:

a nozzle group for directing steam into the turbine;

a control wheel arranged in the path of steam directed into the turbine from the nozzle group;

a transition duct arranged downstream of the control wheel;

means arranged between the control wheel and the transition duct for imparting a swirl onto a flow from the control wheel into the duct so as to equalize the flow within the duct; and reaction blading arranged downstream of the transition duct for extracting useful energy from the equalized flow.

2. The steam turbine as claimed in claim 1, further comprising a swirl space provided in the transfer duct between the swirl imparting means and the reaction blading.

3. The steam turbine as claimed in claim 2, wherein the swirl space includes a curved recess in the transfer duct.

4. The steam turbine as claimed in claim 1, further comprising means arranged in the transfer duct to conserve the swirl imparted to the flow.

5. The steam turbine of claim 4, wherein the conserving means includes a flow guide projecting into the transfer duct, said flow guide including a partial wall extending parallel to the wall of the transfer duct.

* * * * *